United States Patent [19]

Espinosa

[11] 4,108,083

[45] Aug. 22, 1978

[54] PORTABLE WRITING AND READING TABLE ASSEMBLY

[76] Inventor: Albert Espinosa, 838 Riverside Dr., New York, N.Y. 10032

[21] Appl. No.: 793,810

[22] Filed: May 4, 1977

[51] Int. Cl.[2] ..... A47F 5/12

[52] U.S. Cl. ..... 108/6; 5/332 R; 248/455

[58] Field of Search ..... 5/332; 248/441 R, 441 B, 248/441 C, 442.2, 446, 451, 452, 456, 455; 108/6, 8, 9

[56] References Cited

U.S. PATENT DOCUMENTS

| | | | |
|---|---|---|---|
| 551,256 | 12/1895 | Brown | 108/6 X |
| 951,083 | 3/1910 | Singenstreu | 108/8 |
| 1,114,677 | 10/1914 | Brooks | 108/6 |
| 1,691,191 | 11/1928 | Henderson | 248/454 |
| 2,219,091 | 10/1940 | Henderson | 248/456 X |
| 2,538,318 | 1/1951 | Mitchell | 248/455 X |
| 3,104,895 | 9/1963 | Feurbach et al. | 248/455 |
| 3,497,882 | 3/1970 | Weeks | 248/441 B |
| 3,606,450 | 9/1971 | Sedgwick | 108/6 X |
| 3,641,946 | 2/1972 | Charnay | 108/6 |
| 3,698,328 | 10/1972 | Weir | 108/6 |

FOREIGN PATENT DOCUMENTS 880,794 6/1953 Fed. Rep. of Germany ..... 248/441 B

*Primary Examiner*—James T. McCall
*Attorney, Agent, or Firm*—Allison C. Collard

[57] ABSTRACT

A portable writing and reading table assembly includes a pair of spaced-apart stands, each of which includes a generally flat base, an upstanding post secured to the base, and a generally flat writing board, having an elongated holding bar mounted across the lower end thereof and extending outwardly from the front face thereof. Means are provided for rotatably mounting the board between the posts of the stands to permit rotational movement of the board about an axis perpendicular to the longitudinal axes of the posts. Means are also provided for locking the writing board at a desired angle of inclination relative to the axes of the posts. The assembly further includes a generally flat reading board, having a lower end which rests upon the holding bar, and means for adjustably mounting the reading board on the writing board, so as to permit pivotal movement of the reading board about its lower end, and so as to permit adjustment of the angle of inclination of the reading board relative to the plane of the writing board.

2 Claims, 8 Drawing Figures

PORTABLE WRITING AND READING TABLE ASSEMBLY

This invention relates to a portable writing and reading table assembly. More particularly, it relates to a portable reading and writing table, especially useful for bedridden people.

Portable writing and reading tables are, of course, well-known in the art. Typically, these tables include a pair of spaced-apart legs or stands, on which a horizontally-disposed tabletop or board is placed across and rigidly secured thereto. These tables are especially useful for bedridden patients. Generally, the table is placed on the bed with its legs straddling the patient. The patient may then, in a generally sitting-up position, conveniently use the table as a writing surface or for supporting a book, magazine, etc., which he desires to read.

While generally satisfactory, these portable table constructions have been found to be disadvantageous for a number of reasons. In particular, they do not permit the patient to read or write in a generally prone, or lying-down position. In addition, they do not permit a variety of reading and writing positions. Furthermore, due to their generally standardized construction, they often do not provide for table height adjustment, so as to readily accommodate the particular individual's size requirements.

Accordingly, it is an object of the present invention to provide an improved, portable writing and reading table, which is especially useful for bedridden patients.

It is also an object of the present invention to provide such a portable reading and writing table, which permits a variety of reading and writing positions.

It is a further object of the present invention to provide such a reading and writing table, which affords table height adjustability.

It is another object of the present invention to provide a portable writing and reading table having the foregoing attributes and characteristics, which is of simple and inexpensive construction, durable and reliable in operation.

Certain of the foregoing and related objects are readily attained in a portable writing and reading table assembly, which includes a pair of spaced-apart stands, each of which includes a flat base and an upstanding post, secured to the base, and a generally flat writing board, having an elongated holding bar mounted across the lower end thereof, and extending outwardly from the front face thereof. Means are provided for rotatably mounting the board on the posts of the stands, to permit rotational movement of the board about an axis perpendicular to the longitudinal axes of the posts, and means are also provided for locking the writing board at a desired angle of inclination relative to the axes of the posts.

Preferably, the assembly also includes a generally flat reading board, having a lower end which rests upon the holding bar, and means for adjustably mounting the reading board on the writing board, so as to permit pivotal movement of the reading board about its lower end, and to, in turn, permit adjustment of the angle of inclination of the reading board relative to the plane of the writing board. Most advantageously, the adjustable mounting means includes a pair of elongated, hollow, tubular members, one of which is pivotally mounted on the writing board and the other of which is pivotably mounted on the reading board. Each of the members has at least one hole formed therethrough, and one of the tubular members is receivable within the other member, so as to permit alignment of the hole of the one member with that of the other. The mounting means also includes a pin, one end of which has an enlarged head portion, and the other end of which is insertable within the pair of opposing, aligned holes of the members, which serves to secure the members together, as well as for fixing the reading board at a desired angle of inclination relative to the plane of the writing board.

Most desirably, the assembly also includes at least one clip mounted on the writing board, having a resilent arm which extends over the front face thereof, and which serves to securely hold a book or piece of reading material thereon.

In a particularly preferred embodiment, the writing board has a generally rectangular configuration and a flange having a plurality of spaced-apart holes formed therethrough, which depends from each of the lateral edges thereof. Similarly, each of the posts is provided with a plurality of transversely-extending, vertically-spaced-apart holes adjacent the top end thereof, which are alignable with the holes of the flanges. In this case, the mounting and locking means includes at least one bolt having an expanded bolt head at one end and a threaded portion at its other end, which is receivable within the aligned holes of the posts and flanges, and at least one wing nut, theadably receivable on the threaded portion of the bolt for locking the board at a desired angle of inclination; the plurality of holes in the posts and flanges permitting adjustment of the height of the board.

Other objects and features of the present invention will become apparent from the following detailed description, considered in connection with the accompanying drawings which disclose the embodiments of the invention. It is to be understood, however, that the drawings are designed for the purpose of illustration only, and not as a definition of the limits of the invention.

In the drawings, wherein similar reference characters denote similar elements throughout the several views.

Figure 1:
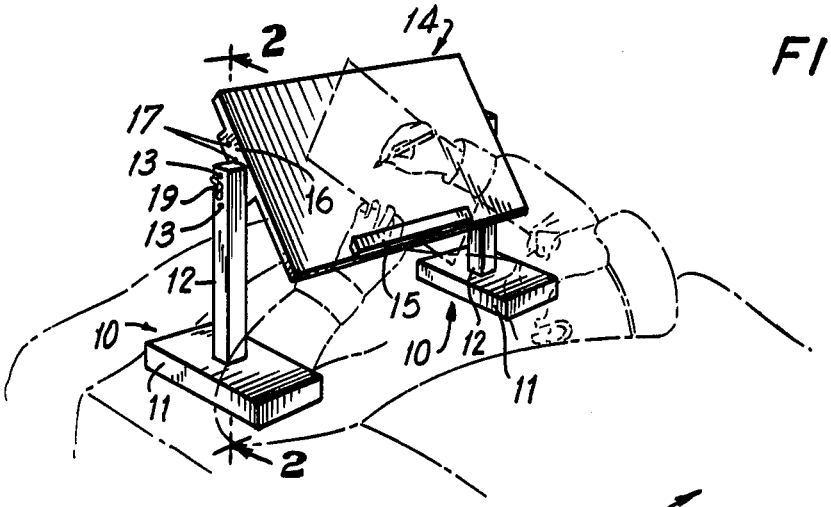
FIG. 1 is a perspective view of the portable reading and writing table, embodying the present invention, which illustrates the portion of the assembly employed for writing purposes, and which shows in phantom line, the assembly mounted on a bed and straddling the user.

Turning now in particular to the appended drawings, therein illustrated is a novel, portable writing and reading table assembly, embodying the present invention and including a pair of spaced-apart stands 10, each of which includes a generally flat, rectangular base 11 and an upstanding, elongated, rectangular post 12, secured to the base 10. Each of the posts has three, transversely-extending, vertically-spaced-apart holes 13 formed therethrough, the purposes for which will be described hereinafter.

Disposed between each of the posts 12 is a generally flat, rectangular writing board 14, which has mounted on its front face, adjacent the lower end thereof, an elongated holding bar 15, which extends transversely thereacross. Writing board 14 also has a pair of flanges 16 depending centrally from the lateral edges of the board, each of which has three, spaced-apart holes 17 formed therethrough, which are alignable with the holes 13 of the respective adjacent posts 12.

Figure 2:
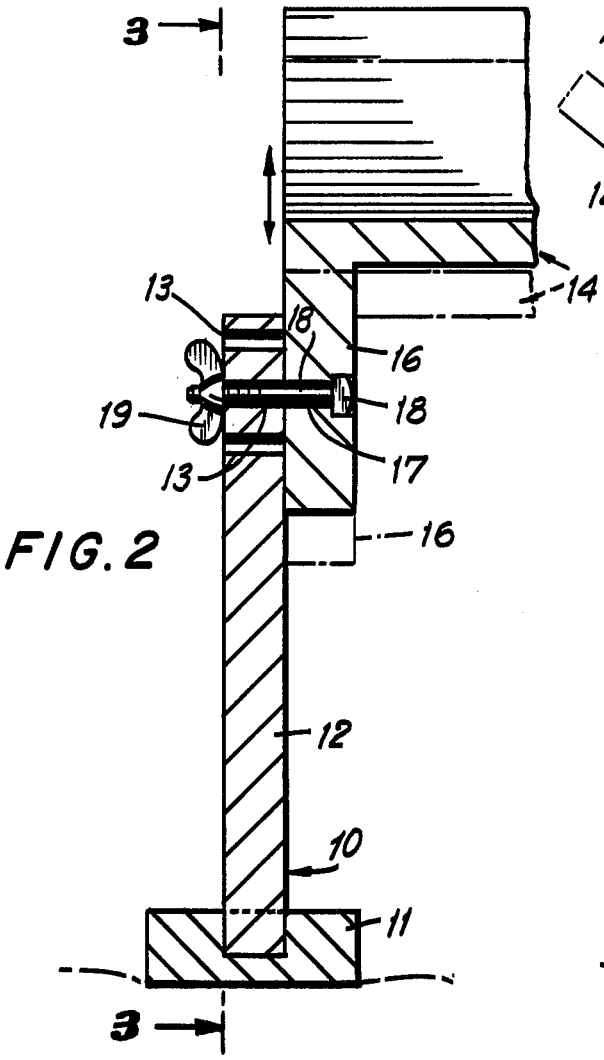
FIG. 2 is an enlarged, cross-sectional view, in part elevation, taken along line 2—2 of FIG. 1.
Figure 3:
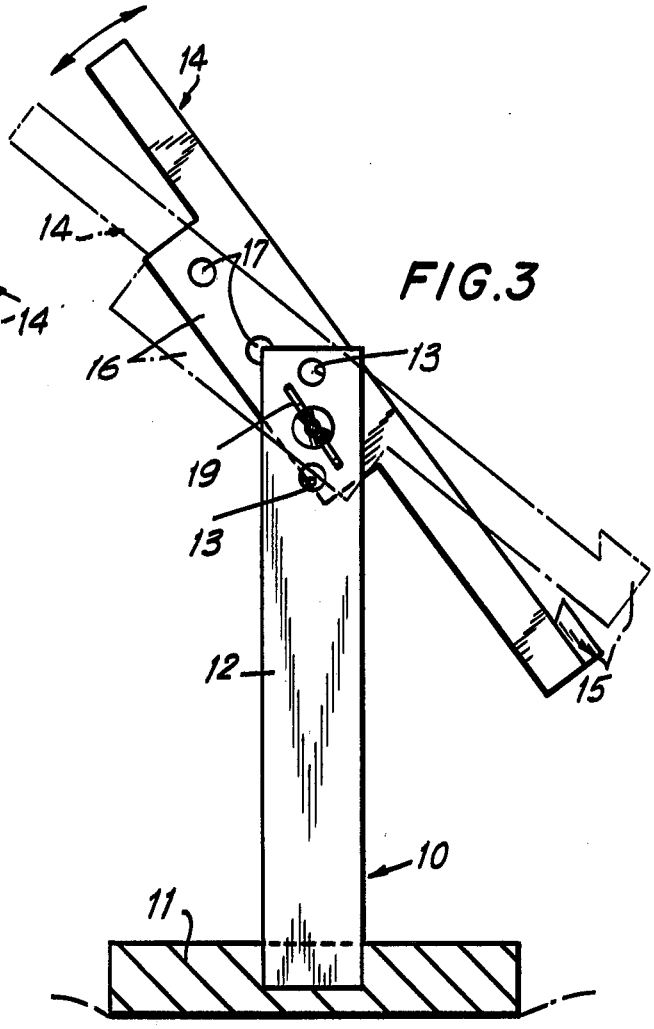
FIG. 3 is a side elevational view, in part section, of the assembly, taken along line 3—3 of FIG. 2.

Writing board 14 is supported on posts 12 by means of a bolt-and-nut assembly, which includes a bolt 18, one end of which has an enlarged bolt head, and the other end of which is threaded, and a wing nut 19, which is threadably receivable on the threaded end portion of bolt 18. As can be seen more clearly in FIG. 2, bolt 18 is inserted into one of the holes 17 of flange 16 and one of the aligned holes 13 of post 12, and the wing nut 19 is threaded onto the outwardly-projecting, threaded portion of bolt 18, to securely fasten board 14 to post 12 of stand 10. As can be appreciated by loosening wing nut 19, writing board 14 may be rotated about bolt 18 and its angle of inclination may be varied to suit the individual user, as shown in FIG. 3; the wing nut may then be retightened to lock the board in place. In addition, the plurality of holes provided in flanges 16 and posts 12, permit height adjustment of board 14; e.g., inserting bolt 18 into the uppermost holes 13 of posts 12 and lowermost holes 17 of flanges 16, will afford the greatest height displacement of board 14 relative to bases 11 of stands 10. As now assembled, the assembly may be used for writing purposes by the individual, as illustrated in FIG. 1.

Figure 4:
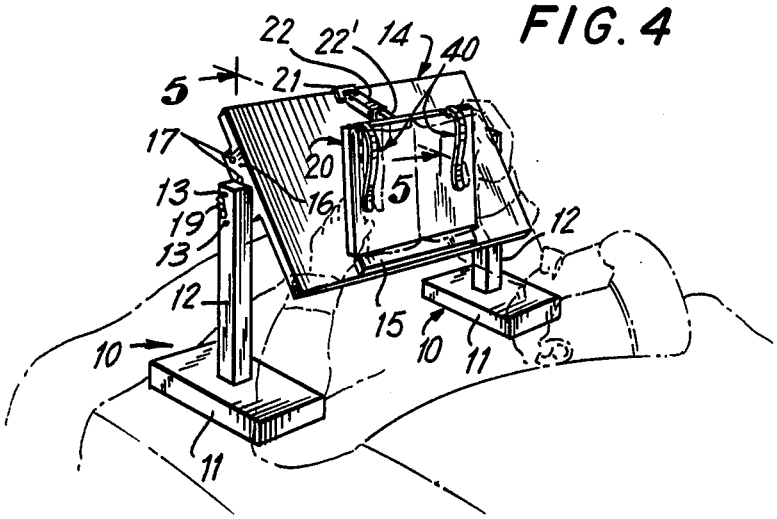
FIG. 4 is a perspective view of the instant assembly, similar to that of FIG. 1, but showing the reading portion of the assembly being employed.

As shown in FIG. 4, the assembly also includes a generally rectangular, flat reading board 20, the lower edge of which rests upon holding bar 15 of writing board 14. Reading board 20 is coupled to writing board 14 by means of an adjustable mounting assembly.

Figure 6:
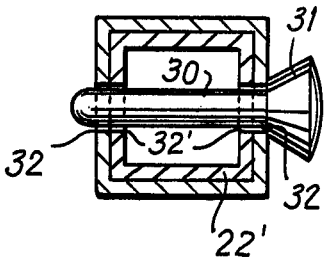
FIG. 6 is an enlarged, cross-sectional view, in part elevation, taken along line 6—6 of FIG. 5.
Figure 7:
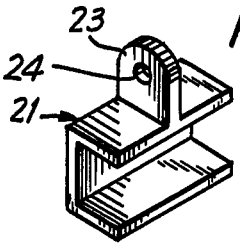
FIG. 7 is a perspective view of one of the pivotal mounting means employed in the assembly, used for coupling the writing board to the reading board.
Figure 5:
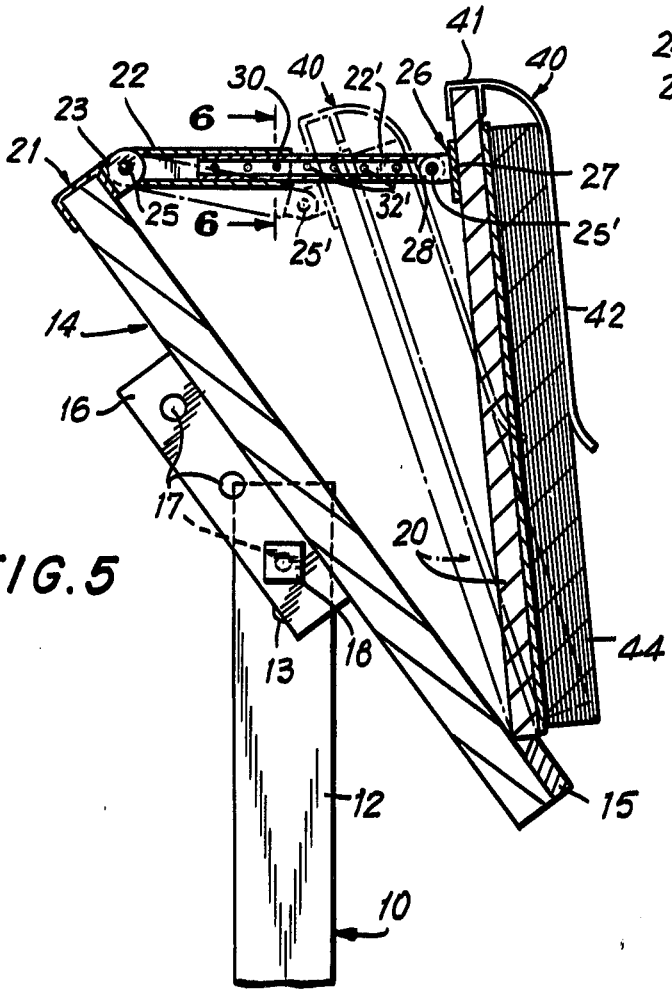
FIG. 5 is an enlarged, cross-sectional view, in part elevation, taken along line 5—5 of FIG. 4.

As seen best in FIGS. 5, 6 and 7, the mounting assembly includes a pair of cooperating, elongated, hollow, tubular, generally rectangular support members 22, 22', one of which 22' is dimensionally smaller than the other 22, so as to be slidably receivable therein. Support member 22 is pivotably mounted on writing board 14 by means of a generally U-shaped bracket 21, which frictionally engages the top edge of board 14 centrally thereof. Bracket 21 has a flange 23 extending outwardly from one of the arms thereof, which has a hole 24 formed therethrough. Support member 22 is provided with a forked end portion, which has aligned holes extending transversely therethrough, in which flange 23 of bracket 21 is receivable, so that the holes of the forked end portion of support member 22 may be aligned with hole 24 of flange 23. A coupling pin 25 is inserted into aligned hole 24 of flange 23, and the holes of the forked end portion of member 22, so as to pivotably secure support member 22 on writing board 14.

In a similar fashion, support member 22' is pivotably mounted on reading board 20, by means of T-shaped mounting bracket 26, the top arm 27 of which is suitably fastened (by means not shown) to the rear face of reading board 20 adjacent the top edge thereof, and the lower and rearwardly projecting arm 28 of which has a hole formed transversely therethrough. Support member 22' is also provided with a forked end portion, having aligned holes extending transversely therethrough, in which rearwardly-projecting arm 28 of bracket 26 is receivable, so that the holes of the forked end portion of support member 22' may be aligned with the hole of arm 28 of bracket 26. A coupling pin 25' is inserted into the aligned holes, so as to pivotably secure support member 22' on reading board 20.

At the opposite end of support member 22, a hole 32 is provided in each of the lateral sides thereof, which are aligned with one another to permit the insertion of a pin therethrough. Support member 22' is provided along the length thereof with a plurality of equidistantly spaced-apart holes 32', formed in its lateral sides as well. Holes 32, 32' may be aligned with one another by sliding member 22', into member 22. A coupling pin 30, having an enlarged head portion 31, is inserted into one of the pairs of aligned holes 32, 32', to secure the two support members 22, 22' together and to thereby fix the angular orientation of reading board 20, relative to the plane of the writing board 14.

As can be appreciated, relative movement between support members 22, 22' will cause pivotal movement of reading board 20 about its lower edge, which rests upon holding bar 15, and concurrently, mirror-like pivotal movement of support members 22, 22' about their forked end portions; extension of support member 22' causing reading board 20 to assume a greater angle of inclination relative to writing board 14 (shown in full line in FIG. 5), and retraction of support member 22', causing reading board 20 to assume a lesser angle of inclination relative to writing board 14 (shown in phantom line in FIG. 5). The desired angle of inclination is fixed by inserting pin 31 in the appropriately aligned set of holes 32, 32'.Subsequently, when the user desires to remove the reading board, he needs only to disengage mounting bracket 21 from writing board 14, to remove both the reading board and its associated mounting assembly.

Figure 8:
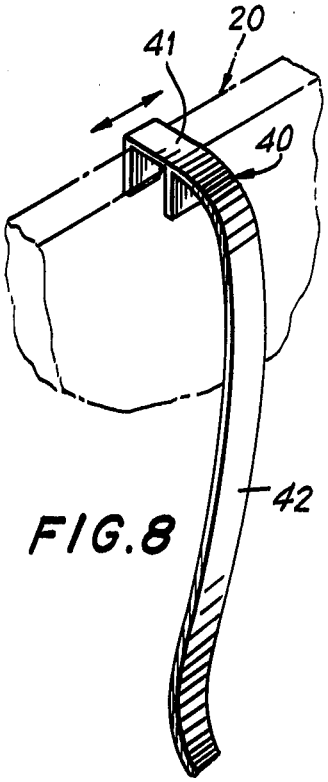
FIG. 8 is a perspective view of the resilient clip used to secure a piece of reading material to the reading board, and showing in phantom line, its frictional securement to the top edge of the reading board.

Reading board 20 is also provided with two resilient clips 40, each of which has a generally U-shaped mounting portion 41, which frictionally engages the top edge of reading board 20, and a generally S-shaped resilient arm 42 extending downwardly therefrom, across the front face of reading board 20, which serves to grip reading material 44, thereunder against the front face of reading board 20. These clips 40 may be slid across the reading board as desired, depending on the dimensions of the reading material, as shown in FIG. 8.

While only one embodiment of the present invention has been shown and described, it will be obvious to those persons of ordinary skill in the art that many changes and modifications may be made thereunto, without departing from the spirit and scope of the invention.

What is claimed is:

1. A portable writing and reading table assembly comprising:

a pair of spaced-apart stands, each including a generally flat base and an upstanding post secured to said base, said posts of each of said stands each having a plurality of transversely-extending, vertically spaced-apart holes formed therethrough adjacent the top end thereof;

a generally flat rectangular writing board, having an elongated holding bar mounted across the lower end thereof, and extending outwardly from the front face thereof, said board also having a flange having a plurality of spaced-apart holes formed therethrough, which depends from each of the lateral edges thereof and which are alignable with the holes of said posts;

means for rotatably mounting said board between and on said posts of said stands, to permit rotational movement of said board about an axis perpendicular to the longitudinal axes of said posts and for locking said writing board at a desired angle of inclination relative to said axes of said posts, said mounting and locking means comprising at least one bolt having an enlarged bolt head at one end, and a threaded portion at its other end which is receivable within the aligned holes of said posts and flanges, and at least one wing nut threadable receivable on said threaded portion of said bolt, for locking said board at a desired angle of inclination, said plurality of holes in said posts and flanges permitting adjustment of the height of said writing board; and a generally flat reading board, having a lower end which rests upon said holding bar, and means for removably and adjustably mounting said reading board on said writing board, so as to permit pivotal movement of said reading board about its lower end and so as to permit adjustment of the angle of inclination of said reading board relative to the plane of said writing board, said adjustable mounting means including a generally U-shaped bracket frictionally and removably mountable on said writing board on a generally T-shaped bracket secured to the rear face of said reading board and a pair of elongated, hollow, tubular members, one of which is pivotably coupled to said U-shaped bracket on said writing board and the other of which is pivotably coupled to said T-shaped bracket, each of said members having at least one hole formed therethrough, and one of said members being receivable within the other member so as to permit alignment of said hole of said one member with that of said other member, said mounting means also including a pin, one end of which has an enlarged head portion and the other end of which is insertable within the pair of opposing, aligned holes of said members for securing said members together, and for fixing said reading board at a desired angle of inclination relative to the plane of said writing board.

2. The assembly according to claim 1 additionally including at least one clip mounted on said reading board, having a resilient arm which extends over the front face thereof.

* * * * *